United States Patent [19]

Slavsky, Sr.

[11] 4,372,066

[45] Feb. 8, 1983

[54] HIGHLIGHTING MARKER FOR MERCHANDISE PRICE SIGN

[75] Inventor: Robert J. Slavsky, Sr., Lathrup Village, Mich.

[73] Assignee: Shaw & Slavsky, Inc., Detroit, Mich.

[21] Appl. No.: 284,073

[22] Filed: Jul. 16, 1981

[51] Int. Cl.[3] ..... G09F 7/08

[52] U.S. Cl. ..... 40/124.1; 40/124.2; 40/490

[58] Field of Search ..... 40/124.1, 124.2, 124.4, 40/490, 489

[56] References Cited

U.S. PATENT DOCUMENTS

| | | | |
|---|---|---|---|
| 1,803,727 | 5/1931 | Rasmussen | 40/490 |
| 2,126,008 | 8/1938 | Hamilton | 40/489 |
| 2,981,018 | 4/1961 | Hopp et al. | 40/16.6 |
| 2,990,196 | 6/1961 | Slavsky | 283/18 |
| 3,706,150 | 12/1972 | Greenberger | 40/124.1 |

*Primary Examiner*—Paul J. Hirsch

*Attorney, Agent, or Firm*—Cullen, Sloman, Cantor, Grauer, Scott & Rutherford

[57] ABSTRACT

A highlighting marker is temporarily secured to a merchandise price display sign panel upon which interchangeable price indicia tags, are positioned, for visually focusing attention to the pricing. The tags have end tabs which are inserted and frictionally held within aligned, spaced apart, raised pockets that are struck out of the panel. The marker has a tongue portion which is closely positioned between an opposed pair of pockets and frictionally gripped between the tag held by those pockets and the panel surface overlapped by that tag. The marker extends laterally beyond one edge of the panel to form an elongated display imprinted portion which visually focuses toward the panel and the price tags thereon. The marker may be formed of a transparent, stiff sheet material so that, from a distance, its display imprint visually appears to be unattached to the panel. Also, the tongue may be cut at an angle relative to the marker display portion to angle the display portion relative to the panel.

7 Claims, 7 Drawing Figures

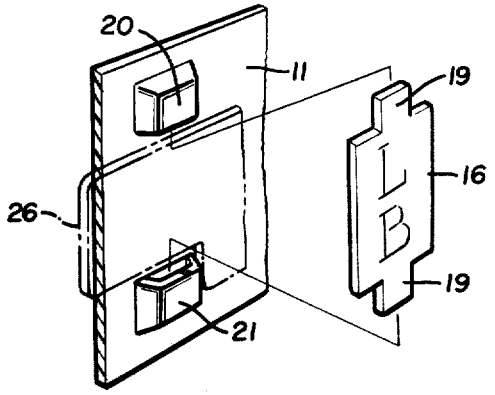
FIG. 6
FIG. 7
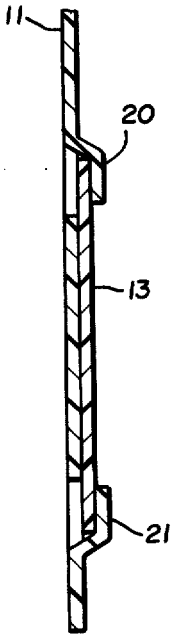
FIG. 4
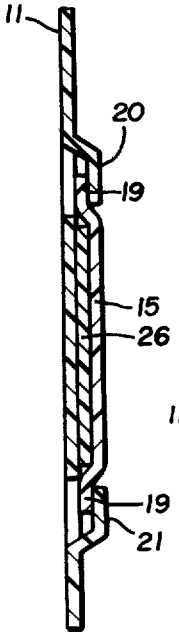
FIG. 5
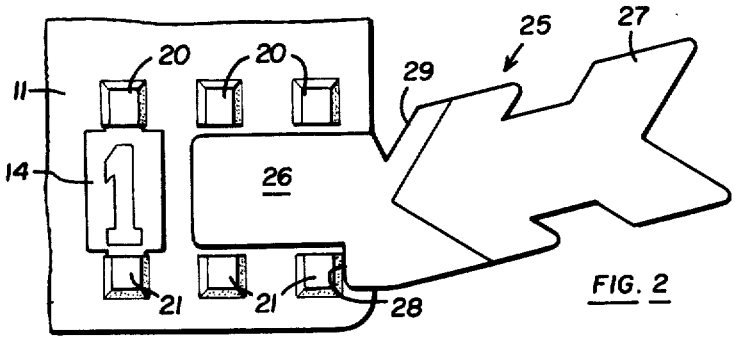
FIG. 2
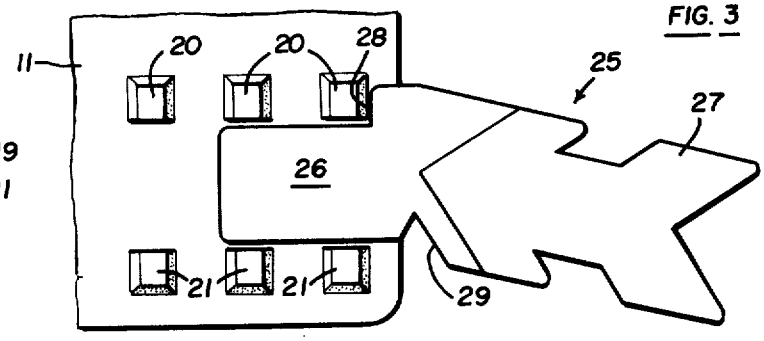
FIG. 3
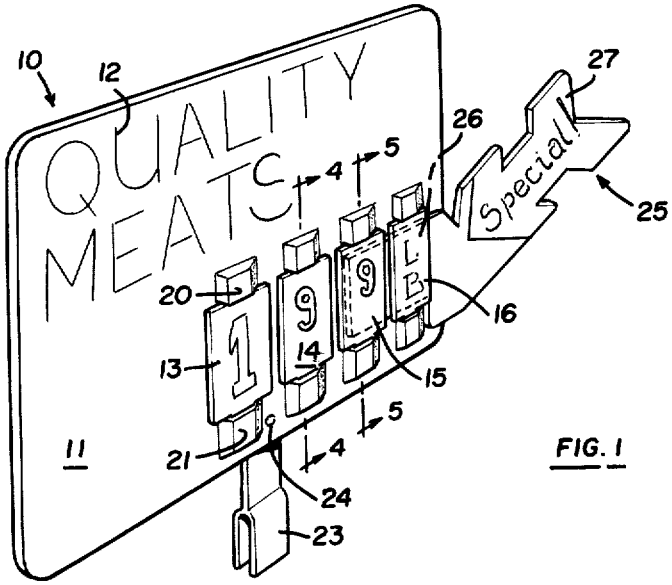
FIG. 1

HIGHLIGHTING MARKER FOR MERCHANDISE PRICE SIGN

BACKGROUND OF INVENTION

In retail stores such as supermarkets, drugstores, hardware stores, general merchandise stores and the like, it is common to use merchandise pricing signs upon which are mounted pricing tags that may be changed to indicate different prices. A well known form of such sign is disclosed in my earlier U.S. Pat. No. 2,990,196, issued June 27, 1961. The sign disclosed in that patent is formed of a flat, thin, stiff sheet which forms a panel. Decorative and informative material may be printed upon the panel for display purposes.

Commonly, each of the price tags have a single number imprinted thereon, so that the tags can be interchanged to display various prices. In order to secure the price tags upon the panel, the tags are provided with tabs at their opposite ends for insertion into opposing slots formed in the panel surface by striking out pocket-like embossments.

Various kinds of supports are utilized to secure this type of sign upon the shelves bearing merchandise or upon support structures adjacent the merchandise shelves.

In many markets, temporary merchandise lower prices or "specials" are made available to the consumer for short times. Ordinarily, additional markers or signs are needed to highlight the location of these "specials". Conventionally available highlight signs or markers, such as large arrow indicating signs or the like, normally are separately mounted near the merchandise, upon supporting structures or shelves. Thus, substantial time is required to manually apply a number of such signs.

In instances where the market manager wants to rapidly call the consumer's attention to a price markdown, as for example, near the closing time of the market where certain items may be marked down for a short period of time, in order to dispose of otherwise perishable goods, or in similar situations, the store clerks have a relatively difficult time highlighting the location of the specials to the consumers. Frequently, the specials cannot be highlighted with signs, which makes it difficult for the consumers to locate.

Hence, an object of the invention herein is to provide a readily available and easily applicable highlight marker which can be utilized in conjunction with pre-existing or pre-positioned merchandise display signs.

SUMMARY OF INVENTION

The invention herein contemplates the provision of a highlighting marker in the form of a thin, stiff strip which is formed at one end with a tongue portion that may be easily inserted between the price tags and the support panel of an already positioned price sign. The strip includes a marker portion, which extends laterally of the sign edge. The marker portion may be formed or imprinted with an attention getting shape, such as in the shape of an arrow, with appropriate indicia. Preferably it is formed of a transparent sheet material so that from a distance, the imprinted marking portion visually appears to be unconnected to the sign panel. Moreover, the tongue portion may be arranged at an angle relative to the display portion of the strip to angle the display portion generally downwardly or pointing upwardly relative to the panel.

A significant advantage of the invention herein is that where display signs are utilized, whenever merchandising specials are announced, the store personnel may easily and rapidly insert "special" markers, which they may easily carry about and handle, with a minimal amount of time and effort. Likewise, the markers may be rapidly removed by simply pulling them outwardly of the signs, and carrying them away.

A further object of this invention is to provide an inexpensive, readily available, special marking system for rapid use when desired, such as at times when pricing specials are announced in a store. Because the structure and printing of the markers are so inexpensive, losses of the markers are insignificant. Nevertheless, the low cost, simple construction, the over-all appearance given by such markers is attractive. They visually appear to be sturdy, permanent displays when used with the pre-existing merchandise price signs.

Still a further object of this invention is to form "special" markers which can be pointed either generally downwardly or upwardly, in order to better highlight the merchandise sign, depending upon the location of the sign relative to the eye level of the consumer.

These and other objects and advantages of this invention will become apparent upon reading the following description, of which the attached drawings form a part.

DESCRIPTION OF DRAWINGS

FIG. 1 is a perspective view of a merchandise price sign with the "special" highlighting marker mounted thereon.

FIG. 2 is an enlarged, fragmentary view of a portion of the sign with the marker positioned between opposing pairs of tab mounting pockets.

FIG. 3 is a view similar to FIG. 2, but showing the marker inverted to point in a generally upward direction.

FIG. 4 is an enlarged, cross-sectional view taken in the direction of arrows 4—4 of FIG. 1 and showing a price tag mounted upon the panel.

FIG. 5 is a view similar to FIG. 4, but taken in the direction of arrows 5—5 of FIG. 1, and illustrates the marker clamped or gripped between a tag and the panel surfaces.

FIG. 6 is an enlarged, fragmentary view of a portion of the panel, illustrating in phantom lines, the tongue of the marker arranged between and engaged with the raised pockets.

FIG. 7 is an enlarged, perspective view of one price tag.

DETAILED DESCRIPTION

FIG. 1 illustrates a conventional merchandise price display sign 10 which comprises a thin, stiff, sheet panel 11 upon which are printed words or designs or the like indicia 12 for imparting information or for decoration of the panel. Mounted upon the panel are a series of pricing indicia tags 13, 14, 15 and 16, which each bear either a number or a quantity or the like type of information to display the pricing information needed by the consumer.

The tags are mounted upon the panel surface by means of providing each tag with upper and lower end tabs 19 (See FIG. 7).

Pairs of aligned and spaced apart upper and lower raised, struck-out or embossed pockets 20 and 21, respectively, are formed on the panel. Each pocket provides an opening or slot 22. The opposed end tabs on the tags are inserted within the pockets, through the slots 22, for mounting the tags upon the panel display surface. When desired, the tags may be removed and interchanged with other tags which have other information, such as different pricing numbers or the like. Also, as can be seen in FIG. 1, the numbers may be printed in different sizes to designate dollars and cents.

The foregoing merchandise price display sign is well known and widely used in various kinds of merchandising establishments and is disclosed in the above mentioned U.S. Pat. No. 2,990,196.

Various kinds of mounting devices may be utilized to mount the sign on shelving or merchandise supports or the like. Thus, for illustrative purposes, a mounting device 23, in the form of a channel with a stem is secured to the panel by means of one or more rivets 24. The channel may be appropriately fastened upon a shelf edge support or the like. The mounting device may be in various forms, such as wire connections which fit within channels or moldings secured upon the shelves, or the like. Thus, the foregoing mounting device is merely illustrative.

Now, turning to the highlighting marker, such device is preferably formed of a flat, stiff, transparent, plastic sheet material formed in the shape of an elongated strip 25. It is provided at one end with a tongue portion 26. Its opposite end forms a marker or highlighting display portion 27 which may be die cut into a configuration, such as an arrow, which emphasizes its marking function. Between the two portions, a vertical shoulder 28 is formed on one side with an opposing notch 29 formed on the opposite side. As can be seen in FIGS. 2 and 3, the tongue and the highlight portions, although in the same plane, are cut at an angle relative to each other. Thus, the marker may be turned, to expose one face or the other face, and point either generally upwardly or generally downwardly, as desired.

Suitable printing 30 may be formed on the highlighting display area, such as a color application in the shape of an arrow. In addition, words or other symbols 31 may be imprinted upon the marker, as illustrated in FIG. 1.

In operation, when it is desired to apply the marker, the store stockboy or clerk, may carry some markers in his pocket or in a container, and select one for insertion on a pre-installed sign. To install the marker, he merely slides the marker parallel to the sign, so that the tongue slips between the sign panel and the tag located nearest to one edge of the panel. Preferably, the tongue is of sufficient length to fit between two adjacent tags. The width of the tongue is of a size to closely fit between the opposed raised pockets 20 and 21, with the shoulder 28 abutting the vertical edge of one of the pockets. Thus, the marker is firmly fixed in position upon the panel against undesired loosening or removal due to the frictional gripping of the marker tongue, and the shoulder contact with the pocket edge.

When it is desired to remove the "special" marker, the clerk simply grasps the extending highlight portion and pulls the marker outwardly in the plane of the sign panel. Hence, removal is virtually instantaneous.

As can be seen, a significant benefit of the improved marker is that it can be applied and removed when desired, with almost no effort and very little time required, thereby making the rapid use of such markers possible, particularly where a number of "specials" may be announced within a short period of time over a store's public address system.

By forming the marker of a transparent material, such as a transparent, stiff plastic sheet of commercially available plastic, the printed highlighting portion visually appears to be floating alongside of, unconnected to, the price sign. This enhances the appeal of the marker and better attracts attention toward the sign and the price upon the sign.

Although the marker is shown as shaped like an arrow, the particular shape and printing thereon can be varied for both aesthetic purposes as well as for varying the kinds of markers in a store to attract the consumer's attention. Thus, the arrow configuration illustrated in the drawings is illustrative of a preferred shape which, however, can be varied.

Having fully described an operative embodiment of this invention, I now claim:

1. A temporary highlighting marker for a merchandise price sign formed of a panel having a surface upon which at least one tag, made of a thin, flat, stiff, sheet material is placed in over-lying, normally face to face contact with said surface, with the tag having pricing indicia imprinted thereon for display upon the panel, and with cooperating interlocking means formed on opposite ends of the tag and the panel areas which said ends overlie for fastening the tag upon the panel, and with the tag portion between said ends being free of securement to the panel, said marker comprising:

a strip formed of thin, flat, stiff sheet material with one end portion formed as a tongue, and its opposite end portion formed as a marking portion which extends laterally of the panel;

said tongue portion being narrower than the distance between the tag opposite ends and being of a width to closely fit between the opposite cooperating interlocking means, and between and in face to face contact with the tag and the panel surface portion which the tag overlies for being frictionally gripped therebetween;

and said tag marking portion having imprinted indicia thereon for providing a highlighting display adjacent the panel near the tag;

and with the marker being manually removeable and replaceable by manually grasping the marking portion and inserting and pulling out the tongue portion from between the tag and panel surface;

and wherein said interlocking means each comprise a raised pocket struck-out of the panel to provide a pair of opposed, aligned slots, with each slot receiving a tab integrally formed on the opposite ends of the tag;

and with the marker tongue portion having an integral shoulder portion for engaging a raised edge of one of the pockets for thereby holding the marker in pre-determined alignment with the panel.

2. A marker as defined in claim 1, and including a second tag similarly positioned upon and similarly fastened upon the panel surface in horizontal alignment with and adjacent to the first mentioned tag;

and said marker tongue portion being of sufficient length for similarly being frictionally gripped between said second tag and the panel surface which it overlies.

3. A marker as defined in claim 1, and said marking portion of the strip being formed in the same plane as, but at an obtuse angle relative to, said tongue portion, whereby the marker may be turned over so that it may be selectively positioned relative to the panel, and so that its marking portion extends at either one or another angle laterally away from the panel.

4. A marker as defined in claim 3, and said marker being formed of a substantially transparent material, with the indicia imprinted upon the marking portion thereof being located upon a portion of the strip which normally extends laterally of, i.e., does not overlie the panel surface, and with the indicia visible from both opposing surfaces; whereby the highlighting display produced by the marker visually appears, from a distance, to be adjacent to, but unattached to an edge of the panel.

5. A merchandise display sign and a selectively applied highlighting marker comprising a thin, stiff, sheet support panel, having a display surface and opposed, spaced apart pairs of raised pockets that are embossed out of the panel to form opposing slots upon the display surface;

tags formed of thin, generally flat, stiff sheet material, normally positioned, in face to face contact with the panel display surface;

said tags having tabs integrally formed upon their opposite ends with each tab fitting within a pocket, through the slot formed thereby, for mounting the tag upon the panel;

with pricing indicia imprinted upon each tag for visual display upon the panels;

said marker being formed of a thin, stiff sheet having a tongue portion formed of a width to closely fit between at least one pair of pockets, and for being frictionally gripped between the tag mounted between said one pair of pockets, and the panel display surface area over which that tag is positioned;

with said marker having a highlighting portion of sufficient length to extend laterally a considerable distance between an edge of the panel, and having highlighting indicia for providing a visually perceptible mark adjacent the panel;

and including a shoulder portion formed on said marker between its tongue portion and highlighting portion, with said shoulder engaging an edge of a pocket which edge is transverse to the slot formed by that pocket, for fixedly positioning the marker relative to the panel.

6. A construction as defined in claim 5, and said marker highlighting portion being in the same plane as, but at an obtuse angle relative to the tongue portion; and the marker having indicia visibly formed on both of its two faces so that it may be manually turned for presenting for visual display either of its two faces relative to the panel display surface;

and with the highlighting portion being angularly arranged relative to the panel and tag.

7. A construction as defined in claim 6, and said marker being formed with an arrow-like visual display appearance, and the marker sheet being substantially transparent from a distance, whereby the arrow-like display of the marker visually appears to be adjacent to, but unconnected with, an edge of the panel, for focusing upon the pricing information displayed by the tags upon the panel surface.

* * * * *